US006201681B1

(12) United States Patent
Torii et al.

(10) Patent No.: US 6,201,681 B1
(45) Date of Patent: Mar. 13, 2001

(54) CONTROL APPARATUS FOR ELECTROMAGNETIC ACTUATOR

(75) Inventors: Minoru Torii; Toshihiro Yamaki; Minoru Nakamura, all of Saitama (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 0 days.

(21) Appl. No.: 09/348,687

(22) Filed: Jul. 7, 1999

(30) Foreign Application Priority Data

Jul. 9, 1998 (JP) ..... 10-193936

(51) Int. Cl.[7] ..... H01H 47/00
(52) U.S. Cl. ..... 361/170; 361/187
(58) Field of Search ..... 361/160, 170, 361/187

(56) References Cited

U.S. PATENT DOCUMENTS 5,214,561 * 5/1993 Morita ..... 361/187
5,717,562 * 2/1998 Morita ..... 361/155

FOREIGN PATENT DOCUMENTS 8-284626 10/1996 (JP) .

* cited by examiner

*Primary Examiner*—Michael J. Sherry
(74) *Attorney, Agent, or Firm*—Lahive & Cockfield, LLP

(57) ABSTRACT

A control apparatus for an electromagnetic actuator for driving a mechanical element by using an electromagnetic coil. The control apparatus includes a circulation circuit for circulating current to be supplied to the electromagnetic coil, a capacitor provided in the circulation circuit and to be charged by the current flowing through the circulation circuit, and a unit for, when the current supplied to the electromagnetic coil is stopped, forming a discharge path for discharging the capacitor and flowing current to an opposite direction through the electromagnetic coil. The current supplied to the electromagnetic coil is charged in the capacitor, then when the current having been supplied to the electromagnetic coil is stopped, the electric charge thus accumulated in the capacitor is discharged thereby to flow current to the opposite direction through the electromagnetic coil. Thus, the current caused by the induced electromotive force generated in the electromagnetic coil due to the stop of the supplied current can be canceled, so that the electromagnetic coil can be quickly demagnetized.

4 Claims, 3 Drawing Sheets

CONTROL SIGNAL

ON
SW1
OFF

ON
SW2
OFF

ON
SW3
OFF

ON
SW4
OFF
FIG. 3 ( f )
VOLTAGE APPLIED TO ELECTROMAGNETIC COIL
T1
T2

CURRENT APPLIED TO ELECTROMAGNETIC COIL
T3
T4

CONTROL APPARATUS FOR ELECTROMAGNETIC ACTUATOR

BACKGROUND OF THE INVENTION

1. Field of the Invention

The present invention relates to a control apparatus for an electromagnetic actuator for driving a mechanical element and, more particularly, relates to a control apparatus for an electromagnetic actuator for driving a mechanical element such as a valve for opening and closing an intake port and an exhaust port of an engine.

2. Description of the Related Art

Conventionally, in some cases, a mechanical element is electrically driven by an electromagnetic actuator in place of mechanically driving it by coupling a cam, a rod or the like thereto. The electromagnetic actuator serves to excite an electromagnetic coil in accordance with an electric signal thereby to drive the mechanical element by the attraction of an electromagnet. The driving timing and the driving force of the electromagnetic actuator can be changed freely by controlling the electric signal, so that the electromagnetic actuator has been employed in many cases in such a field that the precise timing control and variable control are desired.

In a vehicle, the electromagnetic actuators are also employed in various portions in addition to the portion for controlling the opening and closing of an intake valve of an engine. One of the uses to which the electromagnetic actuators are desired to be applied is an intake and exhaust valve for an engine. A system for changing the opening and closing timings of the intake and exhaust valve of the engine depending on the rotation speed range of the engine by using the mechanical structure has been realized. However, if the intake and exhaust valve is driven by the electromagnetic actuator, the opening and closing timings of the intake and exhaust valve can be controlled in various manners and so it becomes possible to improve the output characteristics and the fuel cost of the engine.

In the case of driving the intake and exhaust valve by the electromagnetic actuator, firstly a large overexcitation current for generating energy necessary to start the valve to move from the stationary state is flown into a first electromagnetic coil, and then a relatively small holding current for holding the valve at an opened or closed position is flown into the first electromagnetic coil. Thereafter, a second electromagnetic coil is excited which generates driving force to move the valve to a direction opposite to that moved by the first electromagnetic coil, so that the valve thus moved to the opened or closed position is driven to the closed or opened position by the excitation operation of the second electromagnetic coil in the similar manner as the first electromagnetic coil. When the overexcitation current and the holding current supplied to these electromagnetic coils are cut off, induced electromotive force is generated due to the inductances of the electromagnetic coils, so that the current for continuously attracting the valve at the present position is kept to flow through the electromagnetic coils. As a consequence, since the current flowing through the electromagnetic coils can not be cut off quickly, the responsibility of the valve is degraded.

Japanese Patent Unexamined Publication No. Hei. 8-284626 discloses that a variable resistor unit is inserted into a fly wheel circuit for flowing a current caused by the induced electromotive force which is generated at the time of cutting off a current applied to an electromagnetic coil, and that the resistance value of the variable resistor unit is increased at the time of cutting off the current applied to the electromagnetic coil so that the current caused by the induced electromotive force is rapidly consumed by the resistor thereby to reduce the current.

Further, the publication discloses another embodiment wherein an H-bridge relating to the electromagnetic coil is formed so that, in order to limit the current caused by the induced electromotive force, a current flowing to a direction opposite to that of the current caused by the induced electromotive force is supplied to the coil.

However, according to such a conventional method of reducing the induction current by consuming the electric power through the resistor, the energy generated by the induced electromotive force is wastefully consumed. Further, according to such a conventional method of flowing the current to the direction opposite to that of the current caused by the induced electromotive force, the energy of the power supply is excessively consumed. Furthermore, according to the conventional method, it is required to differ the conduction timing of the current to the opposite direction from the conduction timings of the overexcitation current and the holding current. If the conduction timing of the current to the opposite direction coincides with the conduction timing of the overexcitation current or the holding current, the performance of the switching element of the control circuit may be degraded.

SUMMARY OF THE INVENTION

Accordingly, an object of the present invention is to improve the responsibility of an electromagnetic actuator while saving an amount of consumed electric power.

In order to achieve the aforesaid object, according to the invention, there is provided a control apparatus for an electromagnetic actuator for driving a mechanical element by using an electromagnetic coil, comprising: a circulation circuit for circulating current to be supplied to the electromagnetic coil; a capacitor provided in the circulation circuit and to be charged by the current flowing through the circulation circuit; and means for, when the current supplied to the electromagnetic coil is stopped, forming a discharge path for discharging the capacitor and flowing current to an opposite direction through the electromagnetic coil.

According to the invention, the current supplied to the electromagnetic coil is charged in the capacitor, then when the current having been supplied to the electromagnetic coil is stopped, the electric charge thus accumulated in the capacitor is discharged thereby to flow current to the opposite direction through the electromagnetic coil. Thus, the current caused by the induced electromotive force generated in the electromagnetic coil due to the stop of the supplied current can be canceled, so that the electromagnetic coil can be quickly demagnetized. In this manner, the responsibility of the electromagnetic actuator with respect to a control signal can be improved while saving an amount of consumed electric power.

DETAILED DESCRIPTION OF THE PREFERRED EMBODIMENT

An embodiment of the present invention will be described with reference to the accompanying drawings, in which case, the present invention is applied to an electromagnetic actuator for driving a valve of an engine, for example. The present invention is not limited to the electromagnetic actuator for driving the valve of the engine and may be applied to various types of electromagnetic actuators used in general.

Figure 1:
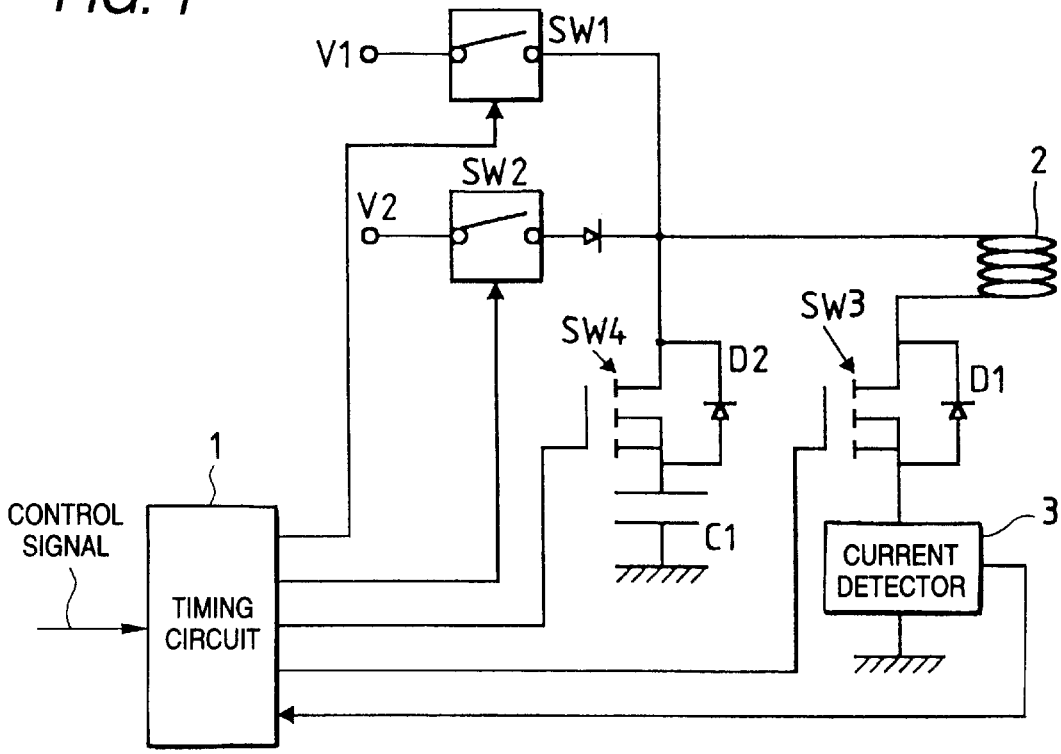
FIG. 1 is a circuit diagram of a control apparatus for an electromagnetic actuator according to an embodiment of the present invention.
Figure 2:
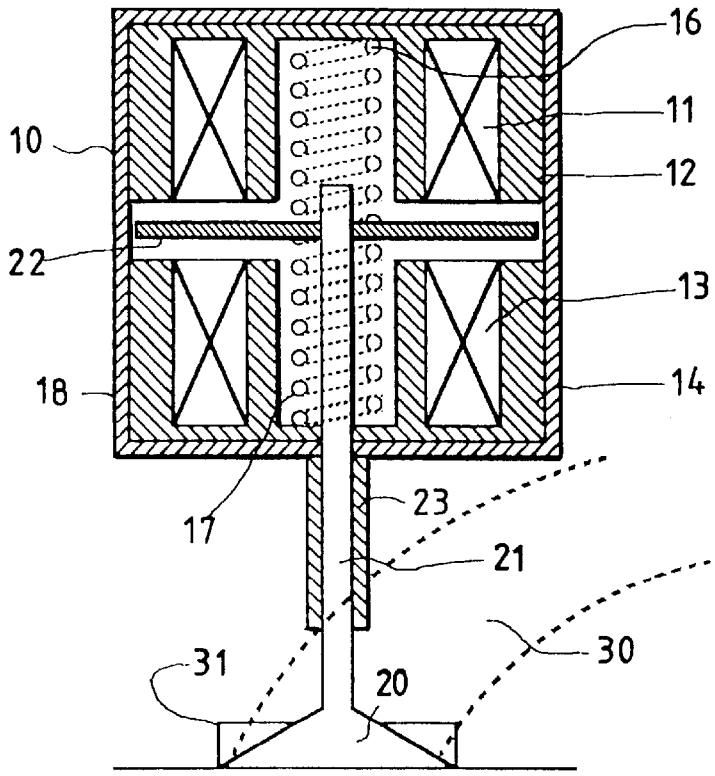
FIG. 2 is a sectional view showing the schematic arrangement of the electromagnetic actuator for driving a valve of an engine.

FIG. 1 is a circuit diagram of a control apparatus for an electromagnetic actuator according to an embodiment of the present invention, and FIG. 2 is a sectional view showing the schematic arrangement of the electromagnetic actuator driven by the control apparatus according to the present invention. First, with reference to FIG. 2, when a valve 20 is driven upward by an electromagnetic actuator 10, the valve 20 is made contact with a valve seat 31 provided at an intake port or an exhaust port (hereinafter referred to as an intake/exhaust port) 30 and stops thereby to close the intake/exhaust port 30. When the valve 20 is driven downward by the electromagnetic actuator 10, the valve 20 moves away from the valve seat 31 and moves downward to the position which is away from the valve seat 31 by a predetermined distance, thereby to open the intake/exhaust port.

A valve shaft 21 of the valve 20 is held by a valve guide 23 so as to be movable in the axial direction. A disk-shaped plunger 22 made of soft magnetic material is attached to the top end of the valve shaft. The plunger 22 is supported by a first spring 16 and a second spring 17 in a manner that the upper surface and the lower surface thereof are pressed by the first and second springs respectively.

A solenoid type first electromagnetic coil 11 positioned at the upper direction of the plunger 22 and a solenoid type second electromagnetic coil 13 positioned at the lower direction of the plunger 22 are provided within a housing 18 made of non-magnetic material of the electromagnetic actuator 10. The first electromagnetic coil 11 and the second electromagnetic coil 13 are surrounded by a first magnetic core 12 and a second magnetic core 14, respectively.

The first spring 16 and the second spring 17 are arranged in a manner that the plunger 22 is positioned in a balanced state at the center portion between the first electromagnetic coil 11 and the second electromagnetic coil 13 when no driving current is supplied to each of the first electromagnetic coil 11 and the second electromagnetic coil 13.

When the first electromagnetic coil 11 is supplied with current, both the first magnetic core 12 and the plunger 22 are magnetized and so attractive force is generated therebetween, whereby the plunger 22 is attracted upward. Thus, the valve 20 is moved upward and closely made in contact with the valve seat 31, so that the valve 20 is stopped and placed in a closed state. When the current having been supplied to the first electromagnetic coil 11 is cut off and current is supplied to the second electromagnetic coil 13, both the second magnetic core 14 and the plunger 22 are magnetized and so force for attracting the plunger 22 to the lower direction is generated. Thus, the plunger 22 is driven downward due to sum of the attractive force and the gravitation applied thereto, so that the plunger 22 is made in contact with the second magnetic core 14 and stopped in this state. In this manner, the valve 20 is placed in an opened state.

The control circuit for the electromagnetic actuator for driving the valve of the engine according to the embodiment of the present invention will be described with reference to FIG. 1. In the figure, symbol V1 denotes a voltage of 100 V, for example, which is obtained by boosting a voltage of 12 V of a power supply for a vehicle, and symbol V2 denotes the voltage of 12 V of the power supply or a voltage obtained by slightly boosting it. A timing circuit 1 controls the operations of the various portions of the valve driving control circuit in accordance with a control signal from an electronic control unit (ECU) for the engine for controlling the operation of the engine. The timing circuit may be a part of the ECU or may be provided separately from the ECU.

The voltage V1 is applied to an electromagnetic coil 2 when a switch SW1 is turned on in accordance with a signal from the timing circuit 1. In this example, the electromagnetic coil 2 is the first electromagnetic coil 11 of the electromagnetic actuator 10. The second electromagnetic coil 13 is also supplied with driving voltage from another control circuit. The switch SW1 is a switch circuit formed typically by a bipolar transistor or a field effect transistor (FET) so arranged that the switch is turned on in response to the control signal applied to the base or gate thereof from the timing circuit 1 and turned off when the control signal applied thereto is cut off. A switch SW2 is a switch circuit similar to the switch SW1 so arranged that the switch SW2 is turned on and off in response to the control signal applied from the timing circuit 1.

The other end of the electromagnetic coil 2 is connected in series with a switch SW3 showed as an FET in FIG. 1 and a current detector 3. The switch SW3 is turned on in response to the control signal applied to the gate thereof from the timing circuit 1 thereby to complete a current path for the electromagnetic coil 2. The switch SW3 is an n-channel FET in this embodiment. A diode D1 is formed by a pn junction between a p-type semiconductor substrate and an n-type drain region and is a parasitic diode originally contained in the n-channel FET. When a switch element not containing such a parasitic diode is employed as the switch SW3, it is required to separately connect a diode in parallel with the switch SW3. The diode D1 forms a discharge path for a capacitor C1 described later.

The current detector 3 detects the current flowing through the electromagnetic coil 2 and sends a detection signal representing the detected current value to the timing circuit 1. The timing circuit 1 performs the feedback control of the electric power being supplied to the electromagnetic coil in accordance with the detection signal.

The one terminal of the electromagnetic coil 2 on the power supply side is connected in series with a switch SW4 and the capacitor C1 thereby to form a circulation path. The switch SW4 is formed by an n-channel FET like the switch SW3 and originally contains a parasitic diode D2. When a switch element not containing such a parasitic diode is employed as the switch SW4, it is required to separately connect a diode in parallel with the switch SW4.

The operation of the control circuit for the electromagnetic actuator according to the embodiment of the present invention will be described with reference to FIG. 1 and the timing charts of FIGS. 3(*a*) to 3(*g*). When the control signal shown in FIG. 3(*a*) is applied from the ECU to the timing circuit, the control signals shown in FIGS. 3(*b*) and 3(*d*) are applied to the switch SW1 and the switch SW3 thereby to turn on these switches, respectively. Thus, the voltage V1 of 100 V, for example, shown in FIG. 3(*f*) is applied to the electromagnetic coil 2, and the driving current shown in FIG. 3(*g*) starts to flow through the electromagnetic coil 2, switch SW3 and current detector 3. That is, the driving current increases with a slightly gentle slope due to the presence of the inductance of the electromagnetic coil. The current flowing through the electromagnetic coil 2 circulates in the electromagnetic coil through the capacitor C1 and the diode D2. In this manner, the capacitor C1 is charged when the driving current flows through the electromagnetic coil 2.

Figure 3:
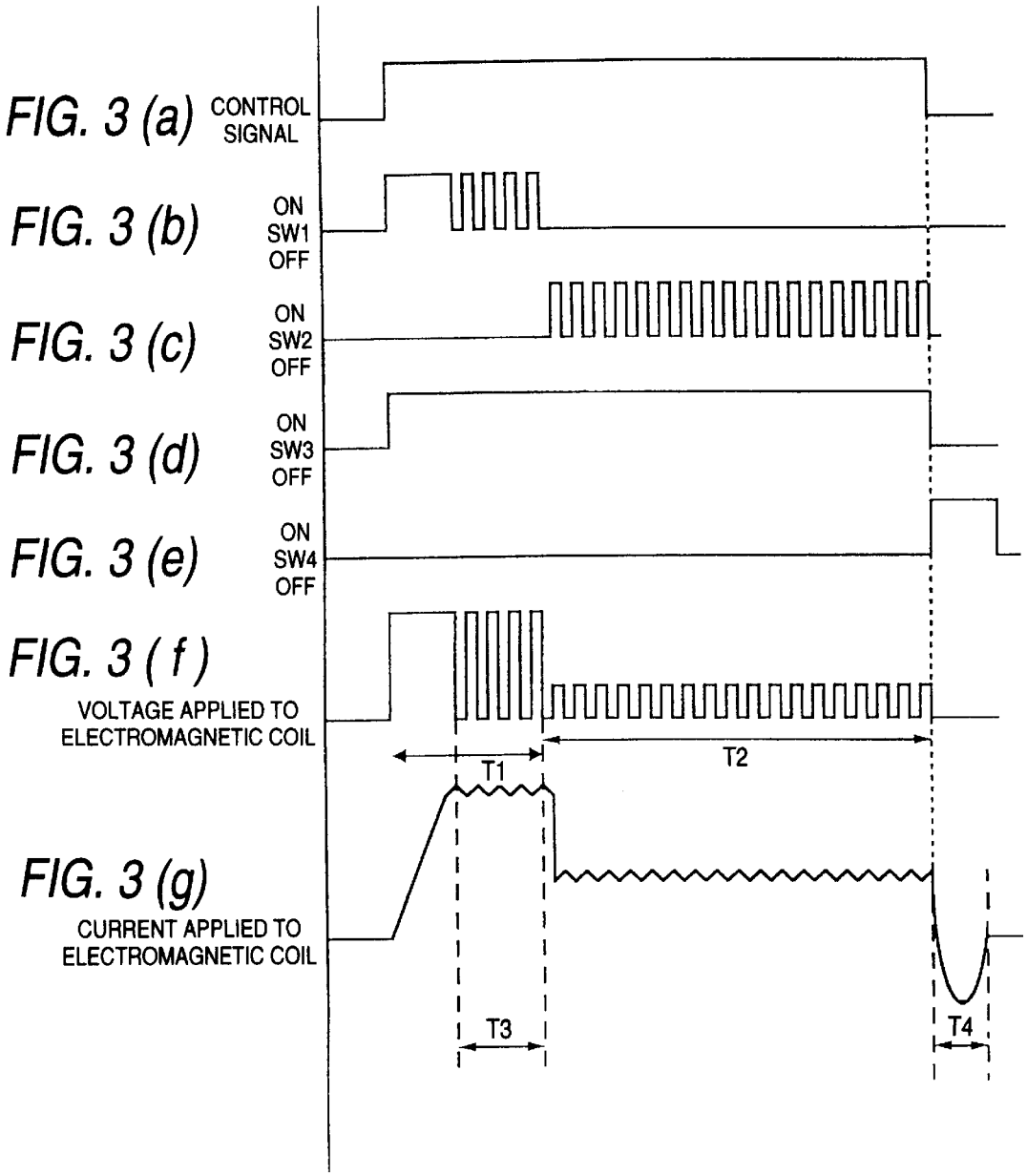
FIGS. 3(*a*) to 3(*g*) are waveform diagrams showing signals at respective portions of the circuit shown in FIG. 1.

After the switch SW1 has been turned on for a period sufficient for rising the driving current in this manner, the switch SW1 is intermittently turned on and off (FIG. 3(*a*)) and so the voltage V1 is intermittently applied to the electromagnetic coil as shown in FIG. 3(*f*). The intermittent switching timing of the switch SW1 is controlled by the timing circuit 1 on the basis of the detection signal from the current detector 3 so that the current flowing through the electromagnetic coil becomes a preset value. In other words, the duty ratio of the control signal supplied to the switch SW1 is subjected to the feedback control in accordance with the detection signal. When a time period T1 (FIG. 3(*f*)) necessary for applying a driving force sufficient for moving the valve 20 has passed, the switch SW1 is turned off and so the voltage V1 having been supplied to the electromagnetic coil is stopped. In stead of the switch SW1, the switch SW2 starts to be turned on intermittently (FIG. 3(*c*)) so that the voltage V2 lower than the voltage V1 is intermittently applied to the electromagnetic coil during a period T2. In this case, also the duty ratio of the voltage V2 supplied to the electromagnetic coil is subjected to the feedback control in accordance with the detection signal from the current detector 3.

In this manner, the valve 20 is driven and moved from the closed position to the opened position, for example, by the electric power of the high voltage V1, and then held at the moved position, for example, the closed position by the electric power of the voltage V2. Although the description has been made as to the case where the electric power supplied to the electromagnetic coil is controlled by the on/off control of the switches SW1 and SW2, the present invention is not limited thereto, and any method may be employed so long as the duty ratio of the electric power supplied to the electromagnetic coil is subjected to the feedback control. Further, the electric power supplied to the electromagnetic coil may not necessarily be subjected to the feedback control by controlling the duty ratio thereof, and may be subjected to the feedback control by controlling the amplitude of the voltage supplied to the electromagnetic coil.

The control signal having been supplied to the switch SW2 is cut off at the timing where the control signal from the ECU is cut off, and simultaneously the switch SW3 having formed the circuit for flowing the driving current is turned off and the switch SW4 is turned on instead thereof (FIG. 3(*e*)). Since the capacitor C1 has been charged with electric charge of the polarity opposite to that of the power supply voltage by the current circulating therethrough during the driving operation of the electromagnetic coil 2, when the switch SW4 is turned on, the discharge path is formed from the ground side electrode of the capacitor C1 to the other electrode of the capacitor C1 through the current detector 3, diode D1, electromagnetic coil 2 and switch SW4, whereby the discharge current flows through the discharge path.

FIG. 3(*g*) schematically shows the waveform of the current flowing through the electromagnetic coil. As shown in this waveform, the current starts to flow through the electromagnetic coil in response to the application of the voltage V1 and then reaches a prescribed value, thereafter maintained at a constant value during a period T3 in accordance with the feedback control of the duty ratio of the voltage applied to the electromagnetic coil. This time period T3 is a time period required for moving the valve from the opened position to the closed position. Upon the lapse of the time period T3, the voltage applied to the electromagnetic coil is changed from the V1 to the V2 as described above, so that the current flowing through the electromagnetic coil 2 decreases to a value necessary for holding the valve to the moved position. When both the switches SW2 and SW3 are turned off and the switch SW4 is turned on, the capacitor C1 starts to discharge and so the discharge current flows to the opposite direction during a time period T4.

This discharge current cancels the current flowing to the forward direction which is caused by the induced electromotive force generated in the electromagnetic coil when the holding voltage V2 having been applied to the electromagnetic coil 2 is stopped, thereby to quickly demagnetize the electromagnetic coil 2. As a result, the electromagnetic operation of the electromagnetic coil 2 can be quickly attenuated and so the plunger 22 can be promptly released.

Figure 4:
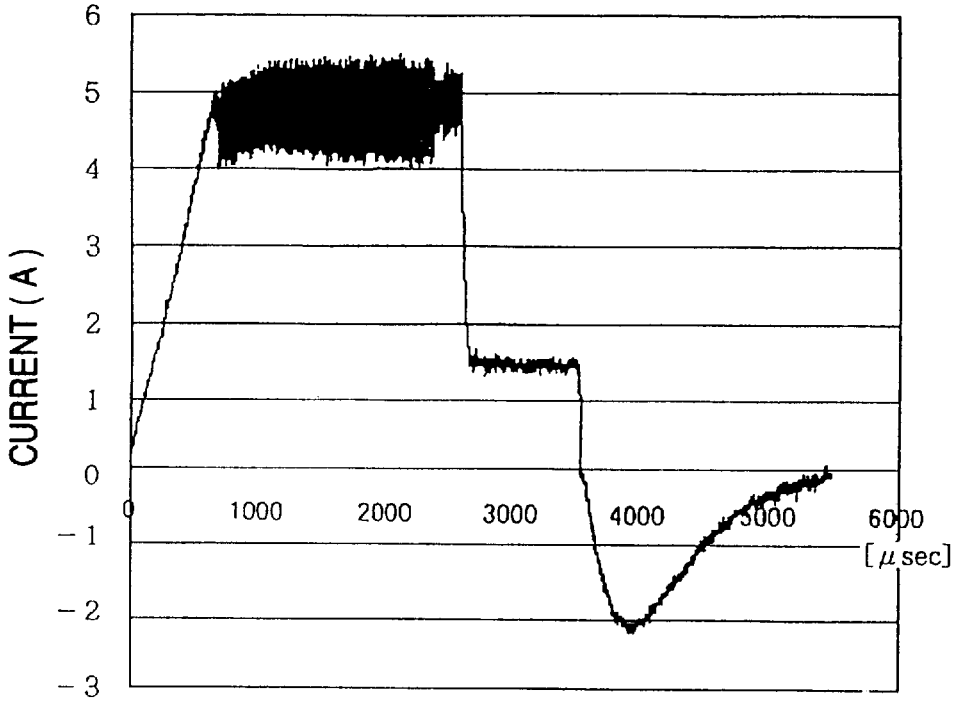
FIGS. 4(*a*) and 4(*b*) are observed waveform diagrams in the circuit shown in FIG. 1.
Figure 4:
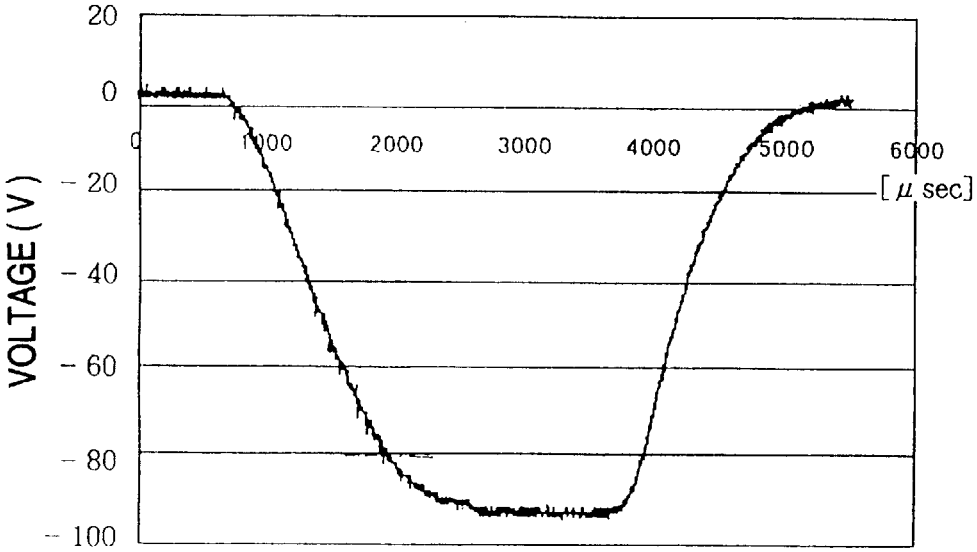

FIG. 4(*a*) is an observed waveform of the current flowing through the electromagnetic coil 2 and corresponds to the waveform of FIG. 3(*g*). FIG. 4(*b*) is an observed waveform of the voltage of the capacitor C1. Such a phenomenon will be observed from these figures that the capacitor is charged by the current flowing through the electromagnetic coil and the current flows to the opposite direction through the electromagnetic coil due to the discharge of the capacitor.

Although the description has been made as to the embodiment of the electromagnetic actuator for driving the valve of the engine, the present invention is not limited thereto, and may be applied to various types of electromagnetic actuators used in general.

According to the invention, the current supplied to the electromagnetic coil is charged in the capacitor, then when the current having been supplied to the electromagnetic coil is stopped, the electric charge thus accumulated in the capacitor is discharged thereby to flow current to the opposite direction through the electromagnetic coil. Thus, the current caused by the induced electromotive force generated in the electromagnetic coil due to the stop of the supplied current can be canceled, so that the electromagnetic coil can be quickly demagnetized. In this manner, the responsibility of the electromagnetic actuator with respect to the control signal can be improved while saving an amount of consumed electric power.

What is claimed is:

1. A control apparatus for an electromagnetic actuator for driving a mechanical element by using an electromagnetic coil, comprising:

a circulation circuit for circulating current to be supplied to the electromagnetic coil;

a capacitor provided in said circulation circuit and to be charged by the current flowing through said circulation circuit; and means for, when the current supplied to the electromagnetic coil is stopped, forming a discharge path for discharging said capacitor and flowing current to an opposite direction through the electromagnetic coil.

2. The control apparatus according to claim 1, wherein said circulation circuit includes a diode provided in series with said capacitor for circulating the current therethrough, and said means for forming the discharge path includes a switch element provided in parallel to said diode and being changed in an on state when the current supplied to the electromagnetic coil is stopped.

3. The control apparatus according to claim 2, further comprising a second switch element provided in series with a negative voltage side terminal of the electromagnetic coil for flowing driving current to the electromagnetic coil, and a second diode provided in parallel to said second switch element to form the discharge path of said capacitor.

4. The control apparatus according to claim 1, wherein the mechanical element is a valve of an engine.

* * * * *